United States Patent [19]

Mikiya et al.

[11] 4,262,374

[45] Apr. 21, 1981

[54] BUBBLE WASH UNIT

[75] Inventors: Toshio Mikiya; Tadahisa Mogaki, both of Tokyo; Nobuyuki Nozawa, Musashino, all of Japan

[73] Assignee: Nikki Co., Ltd., Tokyo, Japan

[21] Appl. No.: 44,487

[22] Filed: Jun. 1, 1979

[30] Foreign Application Priority Data

Dec. 5, 1978 [JP] Japan ..... 53-167886[U]
Jan. 26, 1979 [JP] Japan ..... 54-009223[U]

[51] Int. Cl.[3] ..... A61H 33/06

[52] U.S. Cl. ..... 4/537; 128/367; 128/368; 4/535

[58] Field of Search ..... 4/166, 159, 160, 165, 4/163, 161, 537; 128/366, 368, 367, 66

[56] References Cited

U.S. PATENT DOCUMENTS

| | | | |
|---|---|---|---|
| 1,587,844 | 6/1926 | Landberg | 4/165 X |
| 3,152,240 | 10/1964 | Scott | 128/368 X |
| 3,351,737 | 11/1967 | Katzman et al. | 128/368 X |
| 3,712,307 | 1/1973 | McLaughlin | 128/368 |
| 3,949,743 | 4/1976 | Shanbrom | 128/368 |

FOREIGN PATENT DOCUMENTS

| | | | |
|---|---|---|---|
| 649263 | 11/1962 | Italy | 128/368 |

*Primary Examiner*—Henry K. Artis
*Attorney, Agent, or Firm*—Ostrolenk, Faber, Gerb & Soffen

[57] ABSTRACT

A bubble wash unit is provided with a wash basin for filling water, a stand assembly disposed to the bottom of the wash basin via bayonet coupling, and a bubble assembly disposed to the wash basin via snap coupling while astriding the upper edge of the wash basin in order to pneumatically connect an easily disassembable bubble disc placed on the inside bottom of the wash basin to a compressor suspensibly held within the stand assembly. Easily disassembable construction via bayonet or snap coupling enables complete protection of the compressor against wetting, easy transportation and handling of the unit, and easy replacement and/or cleaning of mechanical elements. A suspensible support successfully damps vibration of the compressor.

45 Claims, 34 Drawing Figures

Fig. 2
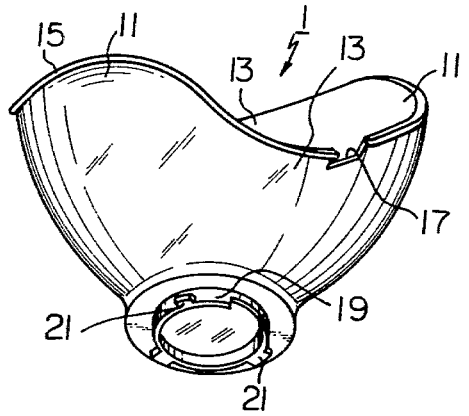
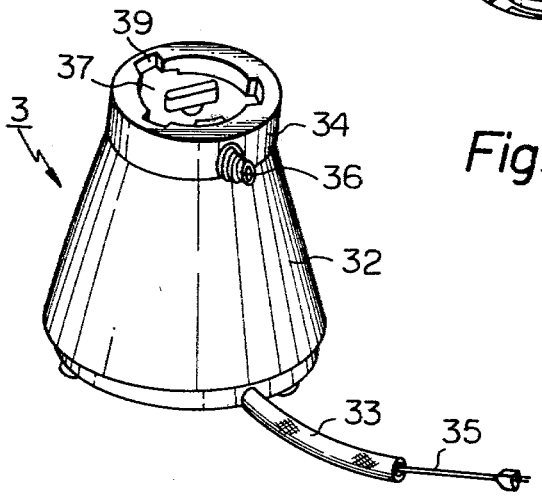
Fig. 3
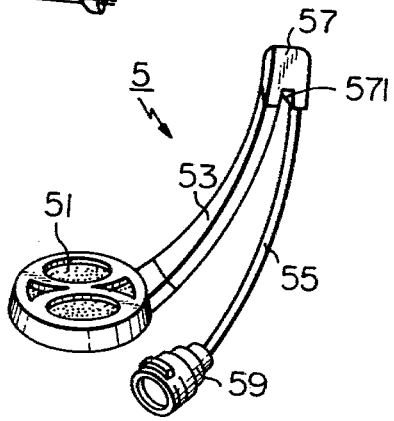
Fig. 4

BUBBLE WASH UNIT

BACKGROUND OF THE INVENTION

The present invention relates to an improved bubble wash unit, and more particularly relates to improvement in the a bubble wash unit in which numerous fine bubbles are generated in water bath filled in a bowl-shaped wash basin.

Bubble wash basins have recently been used widely for cosmetic and/or sanitary purposes on human skins. In a typical construction of a bubble wash basin, compressed air generated by a compressor is supplied to a bubble disc placed on the inside bottom of a bowl-shaped wash basin full of water and divided into numerous fine air voids by passage through the bubble disc. The air voids float upwards in the water bath as fine bubbles which in turn hit the face of the user placed in the water bath, thereby giving moderate impulses to the face skin.

In order to provide the above-described function, the bubble wash unit usually includes a wash basin for containing the water bath and a stand assembly for accommodating the compressor. In order to minimize the space to be occupied by the bubble wash unit and/or needed for storing same, the wash basin is usually mounted atop the stand unit.

The compressor is provided with an electric system which is less durable against wetting on one hand. On the other hand, the wash basin located on the stand assembly has to contain the water bath. In addition, it is necessary in practical use of the bubble wash unit to fill or drain water into or out of the wash basin very often. Further, water may splash out of the wash basin during use of the bubble wash unit. Especially when the bubble wash unit is used for commercial purposes at, e.g. beauty salons, these conditions will be more critical.

Filling, draining and splash of water tend to subject the compressor to wetting problems. Further, the relatively heavy mass of the compressor makes it very inconvenient to transport the bubble wash unit from place to place. Since the bubble wash unit is used for washing faces also, the inside surface of the wash basin is very stained with fatty dirts washed off the faces. Cleaning of such stained wash basins is also accomplished by the above-described wetting and handling problems. Further, the bubble wash unit has a construction in which the wash basin with the water bath is mounted atop the stand assembly containing the compressor and the bubbles are discharged into the water bath at the inside bottom of the wash basin. Due to this construction, any hole must conventionally be formed through the bottom of the wash basin in order to pneumatically couple the interior of the wash basin to the compressor placed under the wash basin. Presence of such a hole also gives rise to water leakage into the stand assembly which may give the wetting problem to the compressor.

A wide variety of bubble wash units have been conventionally proposed on the market. However, none of them was able to solve the above-described troubles totally although some of them were solved by conventional proposals.

A bubble disc is used for reforming compressed air into five bubbles and is provided with a mesh layer for that effect. Since the bubble disc is placed on the inside bottom of the wash basin full of water containing fatty dirts, it is necessary to clean the mesh layer often in order to avoid clogging of same. In addition, since the mesh layer is subjected to high pressure of the compressed air, it easily gets blemished due to repeated tension and this necessitates frequent replacement of the worn-out mesh layer. For such cleaning and replacement purposes, it is strongly required that the bubble disc per se can easily be disassembled and re-assembled even by unskilled users.

In the construction of the bubble wash unit of the above-described type, a compressor is used for generation of compressed air which is to be reformed into fine bubbles. The compressor includes a piston chamber and a piston which axially reciprocates within the piston chamber due to combined operation of electro-magnetic attraction and spring repulsion. This piston reciprocation naturally causes vibration of the compressor and its related parts of the bubble wash unit. Since bubble wash units are used at private homes or at commercial spots such as beauty salons, such vibration is quite unwelcome in general.

Although various proposals have been made in order to damp such vibration of compressors, it has been conventionally impossible to provide sufficient prevention of the vibration while retaining compactness in construction, reduced power consumption and easy assembly.

SUMMARY OF THE INVENTION

It is the principal object of the present invention to provide a novel bubble wash unit which is quite free of troubles conventionally caused by wetting and by the heavy mass of the compressor used for generation of compressed air.

It is another object of the present invention to provide a novel bubble wash unit having a bubble disc which can be very easily disassembled and re-assembled even by unskilled users.

It is the other object of the present invention to provide a novel bubble wash unit in which vibration of the compressor is well damped while retaining compact construction and simple assembly.

In accordance with the basic aspect of the present invention, a wash basin is easily detachably mounted atop a stand assembly and a bubble assembly is easily detachably mounted to the wash basin while resting astride the upper edge of the wash basin in order to pneumatically connect a bubble disc placed on the inside bottom of the wash basin and a compressor placed in the stand assembly.

In accordance with another aspect of the present invention, the bubble disc includes a mesh layer and other related elements which are coupled with each other in an easily detachable fashion.

In accordance with another aspect of the present invention, couplings of related elements are effected by means of snap coupling and/or bayonet coupling.

In accordance with a further aspect of the present invention, the compressor is suspended within the stand assembly by means of a pair of supporting legs standing from the bottom wall of the stand assembly and resilient seats are interposed between the leg tops and pins projecting from the compressor.

DESCRIPTION OF THE DRAWINGS

FIG. 2 is a perspective view of one embodiment of the wash basin usable for the bubble wash unit shown in FIGS. 1A to 1C, FIG. 3 is a perspective view of one embodiment of the stand assembly usable for the bubble wash unit shown in FIGS. 1A to 1C, FIG. 4 is a perspective view of one embodiment of the bubbling assembly usable for the bubble wash unit shown in FIGS. 1A to 1C.

DESCRIPTION OF THE PREFERRED EMBODIMENTS

Figure 1A:
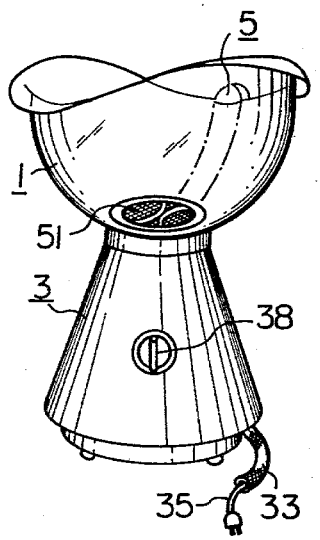
FIG. 1A is a perspective view of an embodiment of the bubble wash unit in accordance with the present invention.

In the following description, mechanical elements substantially common in construction and operation to various embodiments are designated with common reference numerals.

Figure 1B:
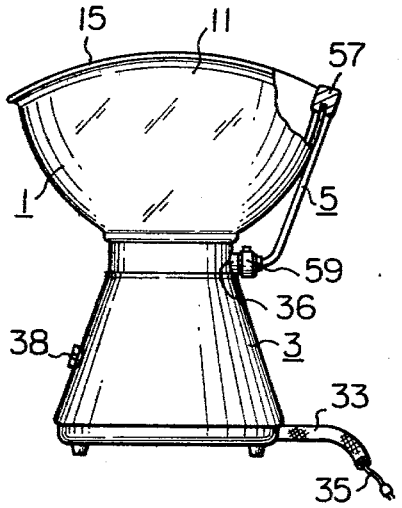
FIG. 1B is a side view, partly in section, of the bubble wash unit shown in FIG. 1A.
Figure 1C:
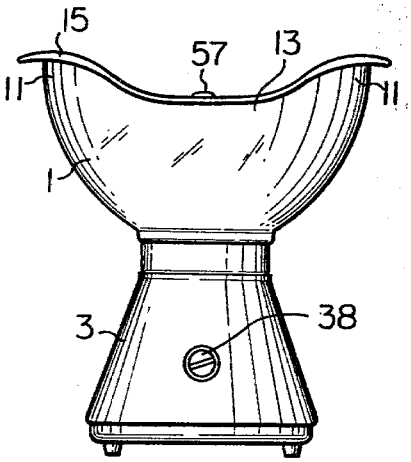
FIG. 1C is a front view of the bubble wash unit shown in FIG. 1A.

The basic embodiment of the bubble wash unit in accordance with the present invention is shown in FIGS. 1A to 1C. The bubble wash unit is made up of a wash basin 1, a stand assembly 3 and a bubbling assembly 5, which are detachably coupled to each other as hereinafter explained in more detail.

The detailed construction of the wash basin 1 is shown in FIG. 2 in a state disassembled from other elements. The wash basin 1 takes the form of a large bowl and the upper edge thereof is made up of a pair of diametrally facing, upwardly convex sections 11 and a pair of diametrally facing, upwardly concave sections 13. The wash basin 1 is preferably made of synthetic resin so that the basin can be produced by resin molding which is suited for mass production.

An outwardly extending brim 15 is formed along the upper edge of the wash basin 1. For convenience in transportation, the brim 15 extends larger in the upwardly convex sections 11. A cutout 17 is formed in one of the upwardly concave sections 13 for the later described coupling to the bubbling assembly 5. This cutout 17 serves as a drain for water in the wash basin 1.

A connection ring 19 is formed about the bottom center of the wash basin 1 and is provided, at the bottom thereof, with a number of outwardly extending locking pawls 21 for the later described coupling to the stand assembly 3.

The detailed construction of the stand assembly 3 is shown in FIG. 3 in a state disassembled from other elements. The stand assembly 3 includes a stand 32 which is given in the form of a cavitious, truncated cone and internally provided with a compressor 31 (see FIG. 9). This compressor 31 is electrically connected to a given outside electric source (not shown) by means of a lead 35 which extends outwards from the bottom of the stand 32 while being covered by a flexible hose pipe 33. This hose pipe 33 is used for introduction of air into the compressor 31.

A connecting ring 34 is formed atop the stand 32 and provided with a top circular hollow 37. This circular hollow 37 is provided along the periphery thereof with locking cutouts 39 adapted for the so-called bayonet coupling to the locking pawls 21 of the wash basin 1.

The diameter of the circular hollow 37 in the upper portion is equal to the outer diameter of the connecting ring 19, the diameter of the circular hollow 37 in the lower portion is equal to that of a circle defined by the outer edges of the locking pawls 21 on the connecting ring 19, and the contour of the locking cutouts 39 is similar to that of the locking pawls 21. Thus a step is formed between the upper and lower portion of the circular hollow 37. The cutouts 39 extend until the step and the depth of the lower portion below the step is similar to the thickness of the locking pawls 21.

Figure 9:
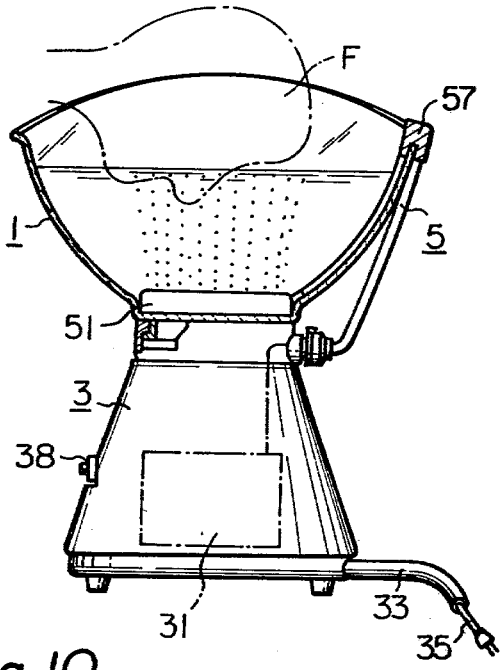
FIG. 9 is a side view, partly in section, of the bubble wash unit shown in FIGS. 1A to 1C in an actually used state.

A male half 36 of a pipe coupler is formed projecting from the connecting ring 34 for the later described coupling to the bubbling assembly 5. This male half 36 is pneumatically connected to the discharge terminal of the compressor 31 as shown in FIG. 9. A switch knob 38 is arranged on the front side of the stand 32 (see FIG. 1C) for switching on and off the compressor 31.

The bubbling assembly 5 is shown in FIG. 4 in a state separated from other elements. The bubbling assembly 5 includes a bubble disc 51 to be placed within the wash basin 1, an elongated, flat air conduit member 53 coupled to the bubbling disc 51, an air hose pipe 55 to be pneumatically connected to the compressor 31, and a connecting block 57 for connecting the two elements 53 and 55 with each other and for coupling the bubbling assembly 5 to the wash basin 1.

The air conduit member 53 is preferably given in the form of an elongated, flat, cavitious belt so that it can well follow the curved inner surface of the wash basin 1 when mounted to the latter and it is preferably made of a flexible material. One or more conduits are longitudinally formed through the air conduit member 53 in order to guide the air from the compressor 31 to the bubble disc 51. One end of the conduit member 53 is coupled to the bubble disc 51 and the other end thereof is coupled to the connecting block 57, both via male-female coupling.

In the illustrated state, the connecting block 57 is provided in the bottom face with a transverse groove 571 which is adapted for coupling to the cutout 17 of the wash basin 1 when the bubbling assembly 5 is to be coupled to the wash basin 1.

One end of the air hose pipe 55 is coupled to the connecting block 57 via male-female coupling and the other end thereof is provided with a female half 59 of the pipe coupler. The female-half 59 is adapted for coupling to the male-half 36 on the stand assembly 3.

Figure 5:
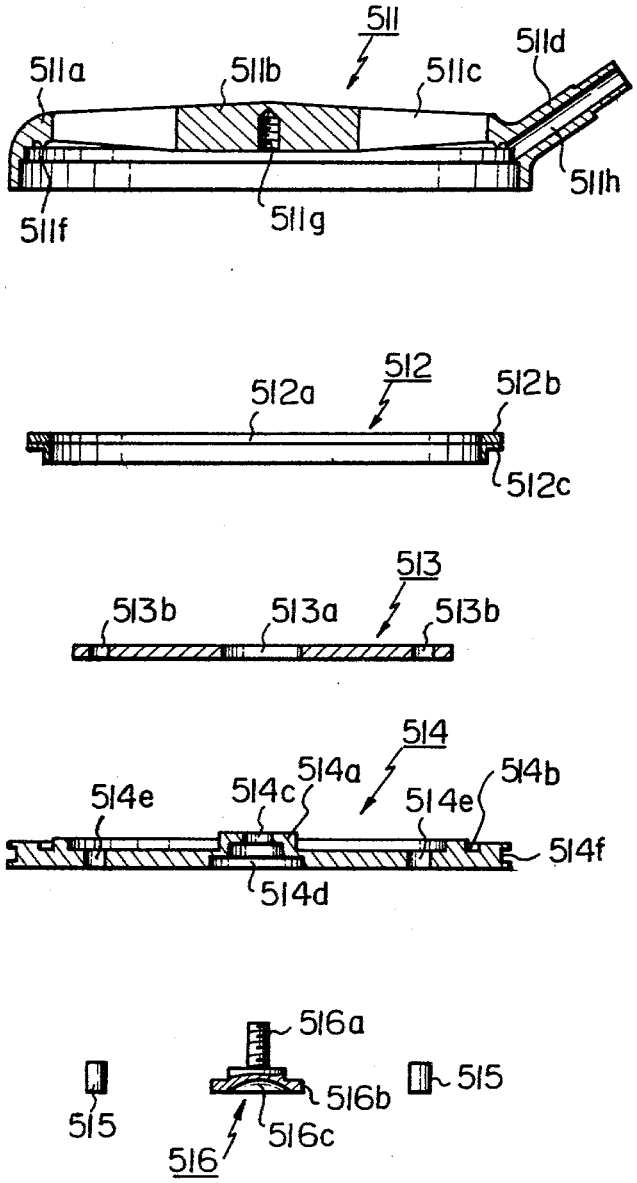
FIG. 5 is a side sectional view of one embodiment of the bubble disc, in a disassembled state, usable for the bubbling assembly shown in FIG. 4.

One embodiment of the bubble disc 51 is shown in FIG. 5 in a disassembled state. The bubble disc 51 includes, as major elements, a top cover 511, a bubble former 512, an intermediate plate 513 and a bottom closure 514, which are detachably coupled to each other via fixing pins 515 and a fastening screw 516.

Figure 6:
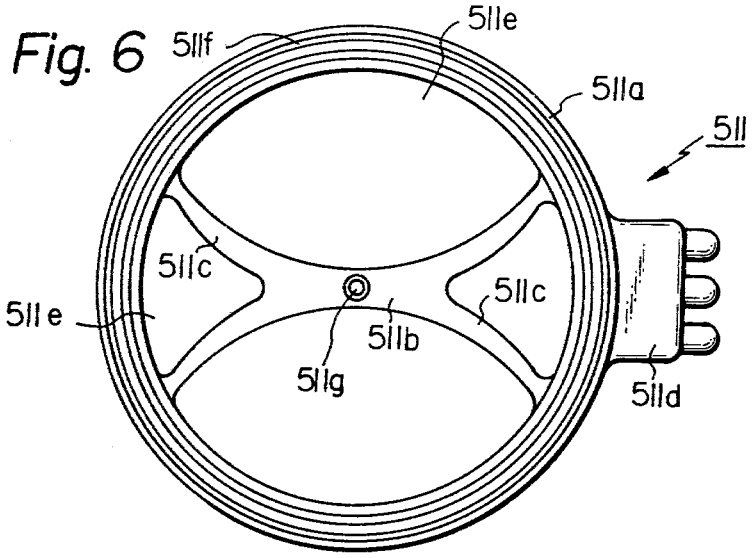
FIG. 6 is a rear side view of the top cover used for the bubble disc shown in FIG. 5.

The rear or bottom side construction of the top cover 511 is shown in FIG. 6. The top cover 511 is comprised of an annular section **511*a*, a central section 511*b*, ribs 511*c* for connecting the two sections 511*a* and 511*b* and a connecting section 511*d* which projects outwards and upwards from the annular section 511*a*. Most of the spaces between the above-described elements form windows 511*e*** for discharge of air bubbles.

The rear or bottom side of the annular section **511*a* is of a three-stepped construction and a sharp annular projection 511*f* is formed on the upper step. A threaded hole 511*g* is formed in the rear side of the central section 511*b* for the fastening screw 516. The connecting section 511*d* is adapted for pneumatic connection with the air conduit member 53 and provided with an air conduit 511*h*** formed therethrough.

The bubble former 512 is comprised of a mesh layer **512*a* made of cloth or a like material and a holder ring 512*b* coupled to the periphery of the mesh layer 512*a* and made of a resilient material such as rubber. The holder ring 512*b* is accompanied on the rear or bottom side by a thin annular valve 512*c* in one body with each other. Here, the outer diameter of the holder ring 512*b* is equal to the diameter of the peripheral wall between the upper and middle steps of the annular section 511*a* of the top cover 511 and the thickness of the holder ring 512*b*** is larger than the distance between the above-described upper and middle steps but smaller than the distance between the upper and lower steps.

The intermediate plate 513 is provided with a center hole **513*a* for its registration at the correct position and a plurality of through holes 513*b* for the fixing pins 515 around the center hole 513*a*. The through holes 513*b* are somewhat smaller in diameter than the fixing pins 515**.

The bottom closure 514 is provided, on the fore side or top side, with a center projection **514*a* and an annular groove 514*b* running along the periphery thereof. A center depression 514*d* is formed on the rear or bottom side of the center projection 514*a* and a through hole 514*c* is formed opening in the depression 514*d*. The through hole 514*c* and the depression 514*d* serve in combination for reception of the fastening screw 516. On the radially inward side of the annular groove 514*b*, a plurality of through holes 514*e* are formed for reception of the fixing pins 515. The height of the center projection 514*a* from the fore side surface of the bottom closure is larger than the thickness of the intermediate plate 513, the outer diameter of the annular groove 514*b* is almost equal to that of the annular valve 512*c* of the bubble former 512, and the depth of the annular groove 514*b* is smaller than that of the annular valve 512*c*. An annular groove 514*f* is formed in the periphery of the bottom closure 514** in order to accommodate a later described ring.

The fastening screw 516 is provided with a threaded section **516*a* and a flange 516*b* formed at one end of the threaded section 516*a*. A straight groove 516*c* is formed on the rear side of the flange 516*b*** for screw drivers.

Figure 7:
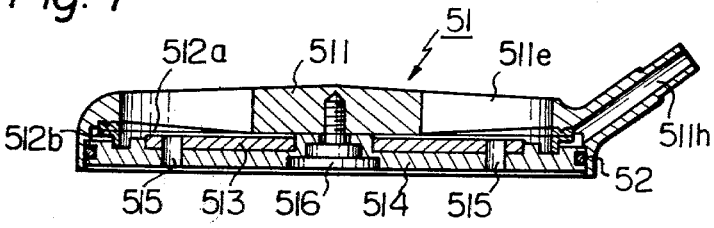
FIG. 7 is a side sectional view of the bubble disc shown in FIG. 5 in the assembled state.

In order to assemble the bubble disc 51, the fixing pins 515 are forcibly inserted into the through holes **513*b* and 514*e*, thereby combining the intermediate plate 513 with the bottom closure 514. Next, the bubble former 512 is coupled to the above-described combination so that the annular valve 512*c* should be received in the annular groove 514*b* of the bottom closure 514 and a seal ring 52 is inserted into the peripheral annular groove 514*f*. Finally, the top cover 511 is mounted to the combination so obtained and the fastening screw 516 is screwed into the thread hole 511*g* of the top cover 511 in order to fix the entire assembly. The bubble disc 51 in the assembled state is shown in FIG. 7**.

Figure 8:
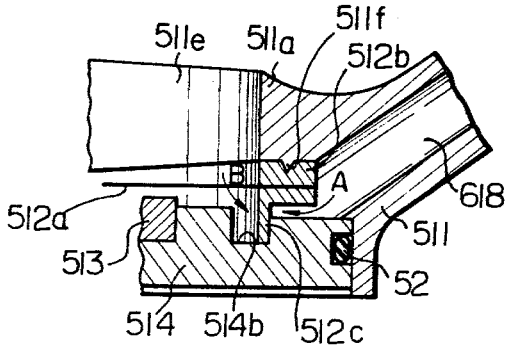
FIG. 8 is an enlarged, fragmentary, side sectional view of the peripheral section of the bubble disc shown in FIG. 7.

The disposition of the peripheral section of the bubble disc 51 in the above-described assembled state is shown in detail in FIG. 8. In this disposition, the sharp annular projection **511*f* of the top cover 511 deeply encroached upon the top surface of the elastic holder ring 512*b* of the bubble former 512 in order to completely seal the coupling of the two elements 511 and 512. Further, the annular valve 512*c* of the bubble former 512 is brought into a tight contact with the outer side peripheral wall of the annular groove 514*b* of the bottom closure 514**.

Therefore, when the air in the air conduit 511*h* follows in the direction shown with an arrow A, the annular valve 512*c* flexes inwards in order to admit passage of the air. When the water in the window 511*e* tends to flow in the direction shown with an arrow B, the annular valve 512*c* is pressed against the outer side peripheral wall of the annular groove 514*b* so that passage of the water should not be admitted. Namely, the annular valve 512*c* operates as a kind of check valve.

In assembling the bubble wash unit, the bottom connecting ring 19 of the wash basin 1 is inserted into the top hollow 37 of the stand assembly 3 and the former is somewhat turned about its center axis so that the locking pawls 21 are wedged by the so-called bayonet coupling, thereby the wash basin 1 and the stand assembly 3 being coupled firmly with each other. Next, the bubble disc 51 in the assembled state is plated on the inside bottom of the wash basin 1, the connecting block 57 is mounted in the cutout 17 of the wash basin 1, and the female-half 59 of the bubbling assembly 5 is coupled to the male-half 36 on the stand 32. This coupling should preferably take the form of the so-called one touch pipe coupled. The completely assembled state of the bubble wash unit is shown in FIG. 9.

In use, water is filled in the wash basin 1 to the prescribed level, the compressor 31 is connected to the given electric source and switched on via the switch knob 38. Compressed air is passed to the bubble disc 51 via the elements 55, 57 and 53 and cut up into small air voids while passing through the bubble former 512 which are driven into the water in the form of numerous fine bubbles. The user put his/her face F within the water in the wash basin 1 so that the rising bubbles bump the face F.

The following advantages result from employment of the present invention.

(i) The wash basin 1 is separable from the stand assembly 3 containing the compressor 31. Therefore, charging and discharging of water into and out of the wash basin 1 can be carried out with the latter being separate from the stand assembly 3. Approach of water to the compressor and its related parts can be completely obviated.

(ii) The above described separable construction enables transportation of the wash basin 1 only for charging and discharging of water. There is no need for carrying the relatively heavy stand assembly which contains the compressor and its related parts.

(iii) The inner side surface of the wash basin 1 is particularly stained during use of the bubble wash unit. The separable construction enables easy cleaning of the wash basin 1 also in a state separated from the stand assembly.

(iv) Since the wash basin 1 is provided on the upper edge with the upwardly concave sections 13, the user can easily put his/her face into the wash basin 1 through the one of the sections, which are suited for drain of water as well. The presence of the outwardly extending brim 15 in the upwardly convex sections 11 enables easy transportation of the wash basin 1.

(v) The presence of the cutout 17 in one of the upwardly concave sections 13 allows easy drain of water in the wash basin 1.

(vi) No hole or aperture is formed in the bottom section of the wash basin though a bubble disc 51 is placed on the bottom. Thus, leakage of water from the wash basin into the stand assembly can be perfectly prevented, thereby successfully precluding any damage on the electric system which otherwise might be seriously caused by wetting.

(vii) Since the air conduit member 53 of the bubbling assembly 5 is made of an elastic material, the repulsion force of the air on the conduit member 53 presses the bubble disc 51 onto the inner bottom of the wash basin 1 when the bubbling assembly 5 is coupled to the wash basin 1, thereby stabilizing the posture of the bubble disc 51 within the wash basin 1.

(viii) Since the air conduit member 53 is in the form of an elongated flat band which well follows the inner curvature of the wash basin 1, there is no undesirable twist of the air conduit member 53, thereby stabilizing the posture of the bubble disc 51 within the wash basin 1 as well.

(ix) The bubbling assembly 5 can be almost completely disassembled as shown in FIG. 5 by simply loosening the fastening screw 516 only. Whenever necessary, therefore, the mesh layer 512*a* can be taken out easily for cleaning.

(x) The presence of the elastic holder ring 512*b* on the periphery of the mesh layer 512*a* provides an enhanced sealing effect. Thus, fine bubbles can be discharged uniformly from the entire surface of the bubble disc 51.

(xi) Since the sharp annular projection 511*f* of the top cover 511 deeply encroaches upon the top surface of the holder ring 512*b* of the bubble former 512, the above-described sealing effect can further be enhanced.

(xii) Since the annular valve 512*c* operates as a kind of check valve, flow of the water in the wash basin into the pneumatic system such as the air conduit 511*h* can be well prevented.

(xiii) Suction of the atmosphere into the compressor 31 is carried out at a position remote from the wash basin 1 by the hose pipe 33 spacedly covering the lead 35. Therefore, even when the water in the wash basin 1 splashes outside, the splashing water is never sucked into the compressor 31 which should be protected from any wetting.

(xiv) The separable wash basin 1 and the stand assembly 3 are coupled to each other and the bubble assembly 5 is coupled to the latter via a one touch type pipe coupler. So, the stand assembly 3 can be used for other purposes as a pneumatic air source after separation from other elements 1 and 3.

(xv) The bubble assembly 5 alone can be used for other purposes such as a bubble bath after separation from other elements 1 and 3.

Figure 10:
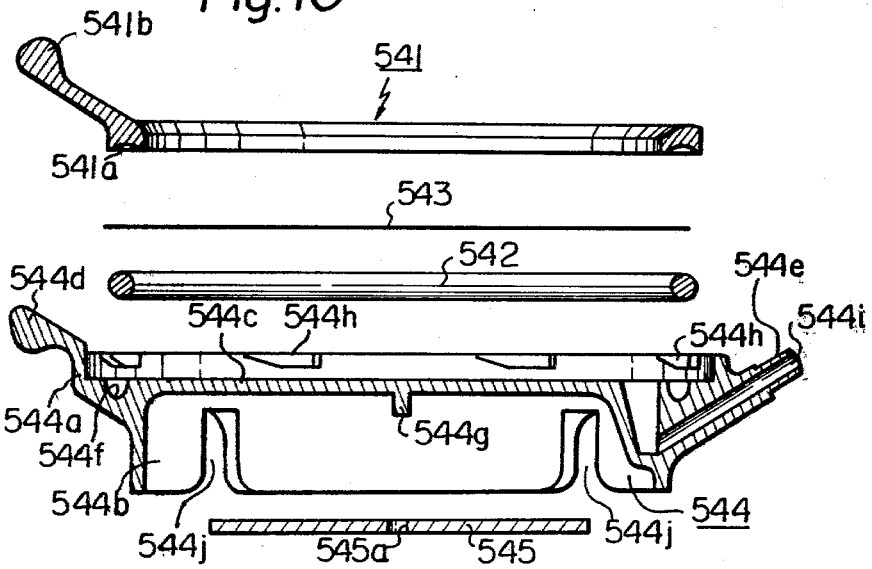
FIG. 10 is a side sectional view of another embodiment of the bubble disc, in a disassembled state, usable for the bubbling assembly shown in FIG. 4.

Another embodiment of the bubble disc in accordance with the present invention is shown in FIG. 10 in a disassembled state. The bubble disc 54 of this embodiment includes a holder 541, a seal ring 542, a mesh layer 543 and a bottom closure 544. When required, a weight 545 may be included as well.

Figure 11A:
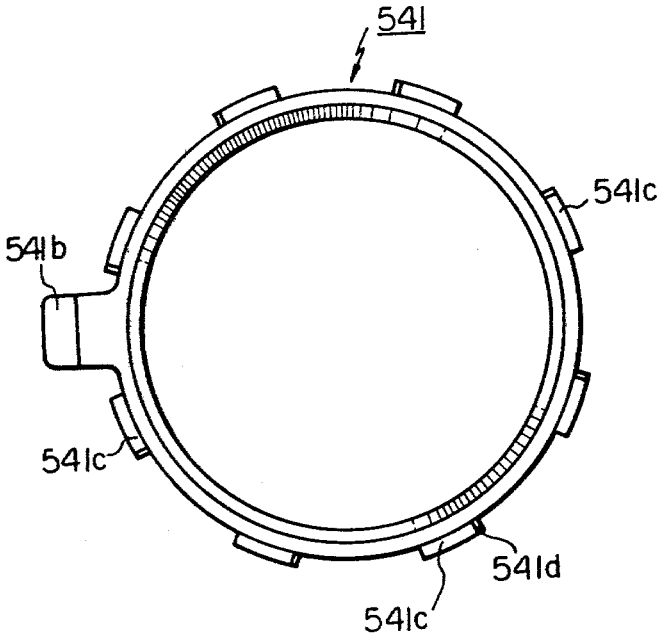
FIG. 11A is a rear side view of the holder used for the bubble disc shown in FIG. 10.
Figure 11B:
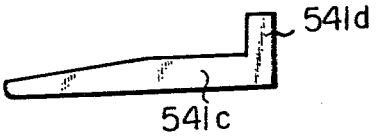
FIG. 11B is an enlarged fragmentary side view of the locking projection formed on the holder shown in FIG. 11A.

The holder 541 takes the form of an annular member which is preferably made of a somewhat resilient material such as synthetic resin. Preferably, an annular groove 541*a* is formed in its bottom or rear side surface and, at a position on its periphery, a slant knob 541*b* is formed while projecting outwards and upwards. As shown in FIG. 11A, a plurality of locking projections 541*c* for bayonet coupling are formed on the periphery of the holder 541. Preferably, a stopper 541*d* is formed at one termination of each locking projection 541*c* as shown in FIG. 11B, which extends towards the top or fore side of the holder 541.

The seal ring 542 is in the form of an annular member which is circular in transverse cross section and made of a resilient material such as rubber. The size of the seal ring 542 is designed so that, when the holder 541 is coupled with the bottom closure 544, the holder can be accommodated within an annular space left between the mating surfaces of the two.

The mesh layer 543 is in the form of a disc made of a woven or nonwoven cloth which has numerous fine meshes. The diameter of the mesh layer 543 is substantially similar to the inner diameter of the bottom closure 544.

The bottom closure 544 is preferably made of a resilient material such as synthetic resin. The bottom closure 544 includes a larger diametral supporting section 544*a*, a small diametral leg section 544*b* formed in one body with the supporting section 544*a*, a bottom section 544*c*, a knob 544*d* and a connecting section 544*e*.

As later described in detail, the bottom section 544*c* defines an air chamber to be left on the rearside of the mesh layer 543 at bubbling. At a position corresponding to the annular groove 541*a* of the holder 541, an annular groove 544*f* is formed in the fore side surface of the bottom section 544*c*. When the above-described weight 545 is to be used, a projection 544*g* is formed on the rear side surface of the bottom section 544*c* for snap coupling with the weight 545.

Figure 12:
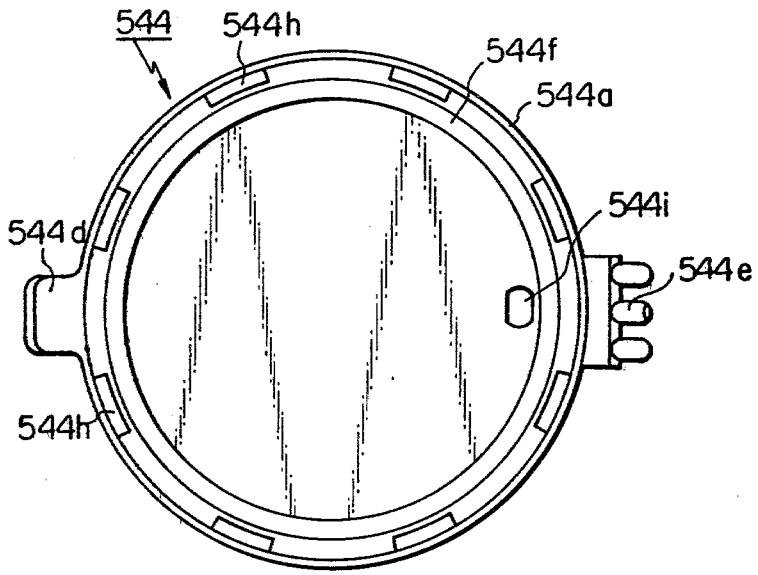
FIG. 12 is a rear side view of the bottom closure used for the bubble disc shown in FIG. 10.

A plurality of locking pieces 544*h* are formed along the inner periphery of the supporting section 544*a* at a position near the fore side edge thereof. The positions and number of the locking pieces 544*h* on the bottom closure 544 shown in FIG. 12 correspond to those of the locking projections 541*c* on the holder 541 shown in FIG. 11A so that they shall be brought into snap coupling.

The connecting section 544*e* is adapted for communication with the given supply source of compressed air and provided with an air conduit 544*i* opening in the peripheral portion of the bottom section 544*c*.

The leg section 544*b* is provided with a plurality of diametral cutouts 544*j* so that, when the bubble disc 54 is placed within the water in the wash basin 1, the air in the space surrounded by the leg section 544*b* can easily escape therefrom, thereby the bubble disc 54 can be stably placed on the bottom of the wash basin 1.

In order to further stabilize the posture of the bubble disc 54 within the water, it is advantageous to use the weight 545. The weight 545 is preferably made of a stainless metal such as stainless steel and provided with a center through hole 545*a* adapted for snap coupling with the bottom projection 544*g* of the bottom closure 544.

Figure 13:
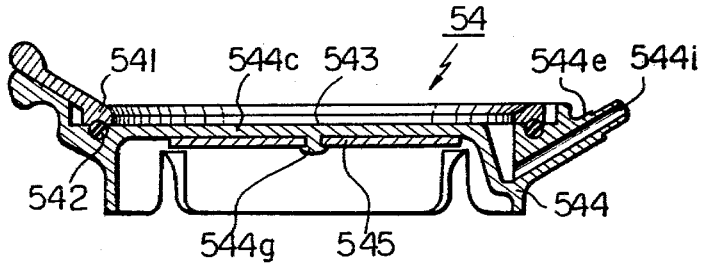
FIG. 13 is a side sectional view of the bubble disc shown in FIG. 10 in the assembled state.

The assembled state of the bubble disc 54 of this embodiment is shown in FIG. 13.

The bubble disc 54 comprised of the above-described element is assembled in the following manner.

The seal ring 542 is placed within the annular groove 544*f* of the bottom closure 544 and the mesh layer 543 is placed thereupon. Next, the holder 541 is placed on the mesh layer 543 so that the annular groove 541*a* thereof meets the seal ring 542 beneath the mesh layer 543 and its locking projections 541*c* do not abut the locking pieces 544*h* of the bottom closure 544.

Figure 14A:
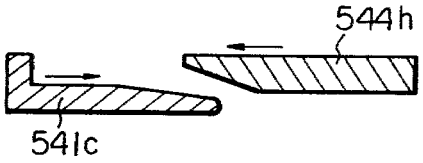
FIGS. 14A and 14B are enlarged side sectional views for showing how the snap coupling between the holder and the bottom closure can be carried out in the bubble disc shown in FIG. 13.
Figure 14B:
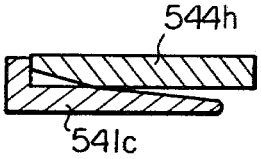

Then, as shown in FIG. 14A, either of the holder 541 or the bottom closure 544 is turned about the center axis of the bubble disc 54 so that each locking projection 541*c* of the holder 541 is snugly inserted into the space under a corresponding locking piece 544*h* of the bottom closure 544, thereby establishing a bayonet coupling of the two elements 541 and 544.

When necessary, the weight 545 is forcibly inserted over the projection 544*g* of the bottom closure 544.

At bubble generation, compressed air from the given supply source is introduced into the underside of the mesh layer 543 via the air conduit 544*i* and pushes the central section of the mesh layer 543 upwards. Thus, a small air chamber is formed beneath the mesh layer 543 which enables uniform dispersion of the compressed air over the entire area of the layer 543. The uniformly dispersed compressed air is then separated into numerous fine air voids after passage through the mesh layer and the air voids move upwards in the water bath in the form of bubbles.

In accordance with this embodiment of the bubble disc, assembly of the bubble disc can be carried out by means of the bayonet coupling only and does not requires use of any special tool for assembly. This simple manner of assembly is especially suited for use of the bubble wash unit by general consumers. As no fastening screws are used for assembly of the bubble disc, the manufacturing cost of the bubble wash unit can be lowered very much. Easy disassembly of the bubble disc enables frequent cleaning and, when required, replacement of the mesh layer which is easily stained and/or blemished during the use. When the weight is used, the posture of the bubble disc in the water bath can be ideally stabilized. As the mesh layer is completely separated from other elements in the bubble disc, the mesh layer alone can be replaced when stained and/or blemished.

Figure 15:
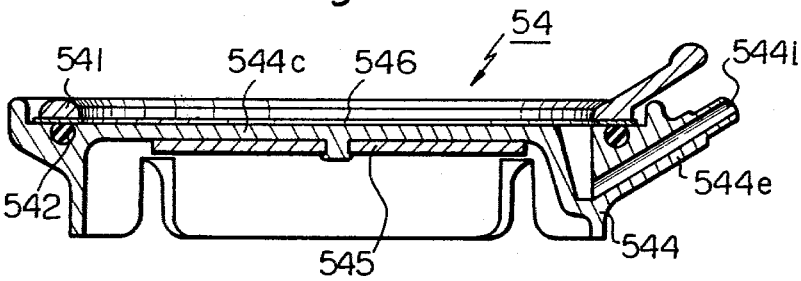
FIG. 15 is a side sectional view of the other embodiment of the bubble disc in accordance with the present invention.

Another embodiment of the bubble disc is shown in FIG. 15, in which a stainless steel thin disc 546 is used as a substitute for the mesh layer 543 used in the foregoing embodiment.

The thin disc 546 is provided with numerous fine perforations extending in the thickness direction. These fine perforations are formed by application of known chemical etching. The thickness of the disc is preferably in the order of 0.1 mm., the distance between neighboring perforations is preferably in the order of 2 mm. or longer and the diameter of the perforation is preferably in the order of 0.2 mm. When the distance between neighboring perforations falls short of 2 mm., bubbles from these perforations combine to form an undesirably large bubble which is unsuited for washing purpose. When the thickness exceeds the above-described value, difficulty arises in cleaning of possible clogging of the perforations.

Figure 16:
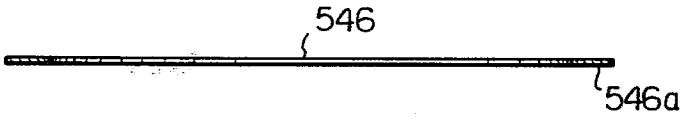
FIG. 16 is a side view, partly in section, of the bubble forming disc used for the bubble disc shown in FIG. 15, FIGS. 17 and 18 are side sectional views of further embodiments of the bubble disc in accordance with the present invention.

As shown in FIG. 16, the bubble forming disc 546 is provided with a protector ring 546*a* which is fixed to its periphery and made of a synthetic resin.

In accordance with this embodiment of the bubble disc, use of the protector ring at the periphery of the perforated stainless steel disc prevents undesirable breakage of the disc despite its extremely thin construction. Further, use of the protector ring effectively prevents leakage of the compressed air at the periphery of the stainless steel disc. As the thin disc is made of a metallic material, the disc well stands pressure of the compressed air, thereby greatly minimizing local breakage and/or stretch of same even after a long use.

Figure 17:
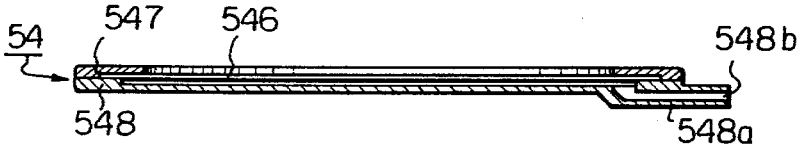

A further embodiment of the bubble disc in accordance with the present invention is shown in FIG. 17, in which a thin stainless steel plate is used for the bubble forming disc also.

The bubble disc 54 of this embodiment is comprised of a top cover 547, a bubble forming disc 546 and a bottom closure 548 formed in one body with the top cover 547 via molding. The top cover 547 has the form of an annular member made of a synthetic resin. The bubble forming disc 546 is fixed at the periphery thereof to the rear or bottom side surface of the top cover 547. The bottom closure 548 is also made of a synthetic resin and is provided with a diametrally projecting connecting section 548*a* having an air conduit 548*b*. The bottom closure 548 is designed so that, when the bubble disc 54 is assembled, a small air chamber should be left beneath the bubble forming disc 546. As compressed air is introduced into the air chamber via the air conduit, the thin bubble forming disc 546 is pushed upwards by pressure of the compressed air and the air chamber is enlarged thereby admitting uniform dispersion of the compressed air over the entire area of the bubble forming disc 546. The bubble forming disc 546 can be attached to the top cover 547 during molding of the latter.

Figure 18:
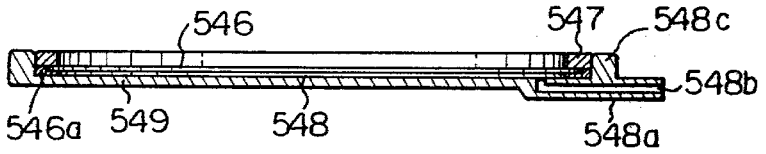

A still further embodiment of the bubble disc in accordance with the present invention is shown in FIG. 18. In the case of this embodiment, the bottom closure 548 is provided along its periphery with an annular projection 548*c* and the bubble forming disc 546 is separate from the top cover 547 and provided at the periphery thereof with the protector ring 546 which is made of a synthetic resin.

At assembly of the bubble disc 54, the top cover 547 is inserted into the space defined by the annular projection 548*c* of the bottom closure 548 while sandwiching the bubble forming disc 546. In order to stably fix the assembly, the top cover 547 may be designed so it is forcibly inserted into the space defined by the annular projection 548*c* of the bottom closure 548. As an alternative, a bayonet coupling construction may be utilized for this stable fixing like the embodiment shown in FIG. 10.

Figure 19:
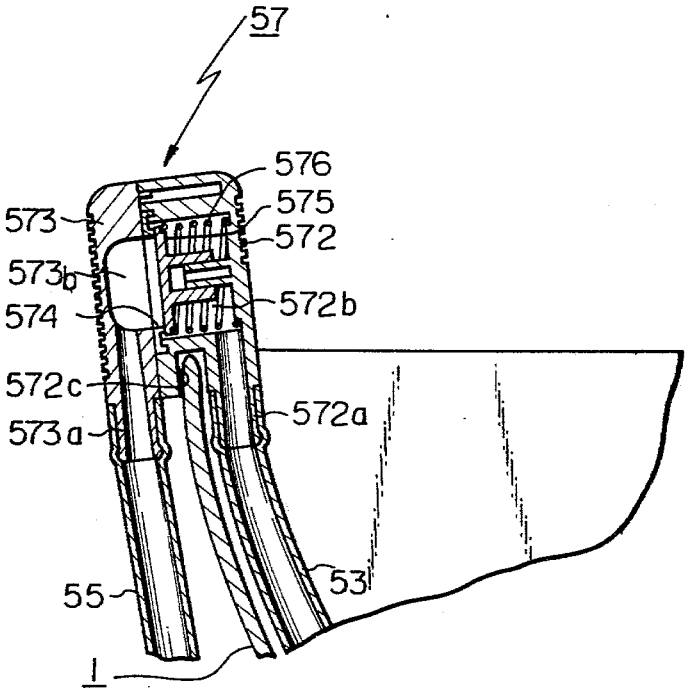
FIG. 19 is an enlarged fragmentary view of another embodiment of the bubbling assembly in accordance with the present invention.
Figure 20:
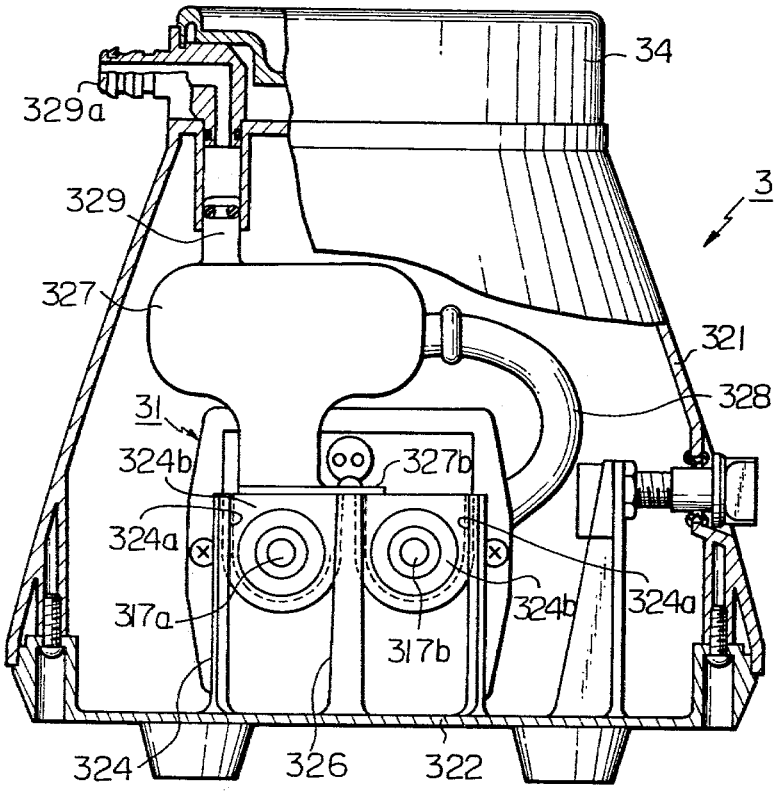
FIG. 20 is a sectional view of one embodiment of the stand assembly used for the bubble wash unit in accordance with the present invention taken along a vertical plane normal to the axial direction of the compressor.

Another embodiment of the bubbling assembly 5 in accordance with the present invention is shown in FIGS. 19 and 20. As already described, the bubbling assembly 5 is comprised of a bubble disc 51 or 54, an air conduit member 53, an air hose pipe 55 and a connecting block 57, and this embodiment mainly concerns the construction of the connecting block 57.

The connecting block 57 is comprised of a first block half 572 and a second block half 573 coupled with each other via a packing 574.

The first block half 572 is provided with a coupling section 572*a* adapted for coupling with the upstream terminal of the air conduit member 53 placed within the wash basin 1. The first block half 572 internally defines a chamber 572*b* which opens in the mating surface of both halves 572 and 573 and in communication with the interior of the air conduit member 53. A check valve 575 is placed within the chamber 572*b* and pressed by a compression spring 576 so as to resiliently close the above-described opening of the chamber 572*b*.

The second block half 573 is provided with a coupling section 573*a* adapted for coupling with the downstream terminal of the air hose pipe 55 placed outside the wash basin 1. The second block half 573 internally defines a chamber 573*b* which opens in the mating surface of both halves 572 and 573 and in communication with the interior of the air hose pipe 55.

In the case of the illustrated embodiment, a transverse groove 572*c* is formed in the surface of the first block half 572 adjacent to the coupling section 572*a*. When the bubbling assembly 5 is to be attached to the wash basin 1, the connecting block 57 is inserted over the upper edge of the wash basin 1 via the transverse groove 572*c*. As a substitute for the transverse groove 572*c*, the coupling sections 572*a* and 573*a* may be designed so that, when the connecting piece 57 is set to the wash basin 1, they firmly clamp the upper edge of the wash basin 1.

Since the bubbling assembly of this embodiment is provided with the check valve which does not admit flow of water from the air conduit member to the air hose pipe, undesirable invasion of water into the pneumatic system can be effectively avoided. Otherwise, water may flow into the pneumatic system when the bubble disc is taken out of the water bath while maintaining its communication with the pneumatic system. In addition, the bubbling assembly is reliably attached to the wash basin due to snug engagement of the transverse groove of the connecting piece with the upper edge of the wash basin or due to clamping of the upper edge of the wash basin by the coupling sections of the connecting piece. Therefore, even when the wash basin is lifted while maintaining connection of the bubbling assembly with the pneumatic system, flow of water into the pneumatic system can be effectively avoided. This is particularly important when operation of the check valve has deteriorated after long use of the bubble wash unit.

Figure 21:
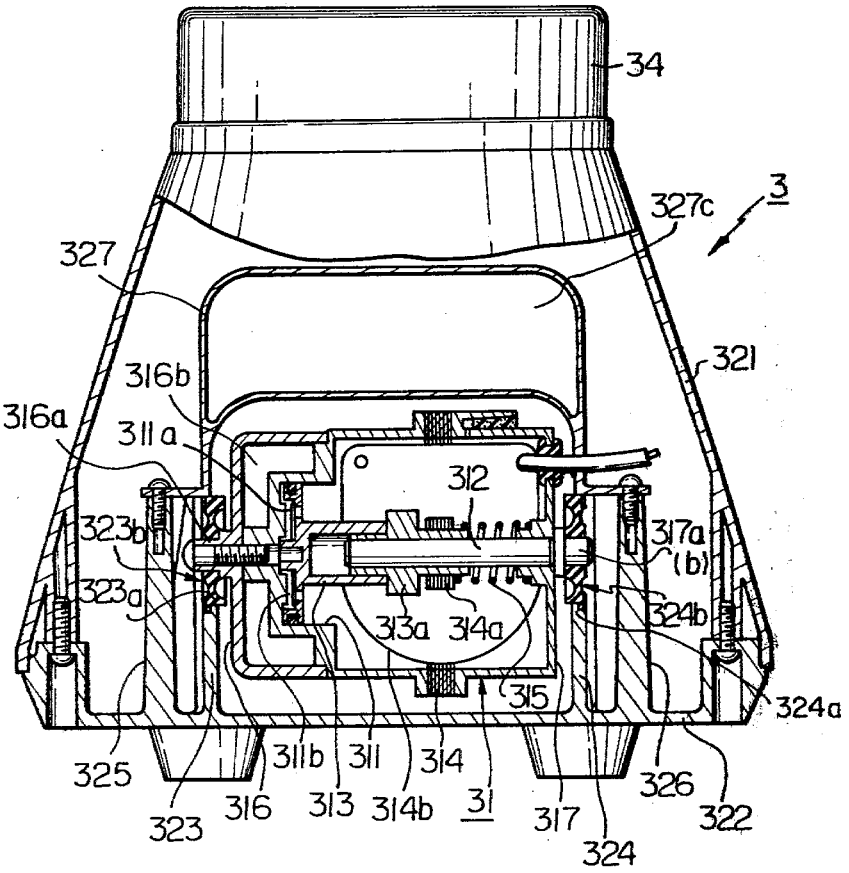
FIG. 21 is a sectional view of the above-described stand assembly taken along a vertical plane parallel to the axial direction of the compressor.

One embodiment of the stand assembly in accordance with the present invention is shown in FIGS. 20 and 21, in which the stand assembly 3 includes, as major elements, a compressor 31 and a stand 32.

The compressor 31 is internally provided with a piston cylinder 311 and a fixed center shaft 312 extending axially forwards towards the piston cylinder 311. A piston assembly 313 is provided near one end thereof with a magnetic armature 313*a*. A stator core 314 is fixed to the casing of the compressor 31 and provided with a pair of magnet poles 314*a* and a pair of coil windings 314*b* which are electrically connected to a given source of electric power. The arrangement is designed so that the piston assembly 313 axially reciprocates through the space defined between the pair of magnet poles as the stator core 314 is energized and deenergized. A coil compression spring 315 is interposed between the armature 313*a* and the end surface of the casing of the compressor 31 for return movement of the piston assembly 313 when the stator core 314 is deenergized.

The air is introduced into the compressor 31 via a suitable filter (not shown) disposed to the casing. As the piston assembly 313 moves rearwards due to electromagnetic attraction, the air pressure within a piston chamber 311*a* lowers and a check valve 311*b* opens in order to admit air into the piston chamber 311*a*. As the piston assembly moves forwards due to spring repulsion, another check valve (not shown) opens due to the raised air pressure within the piston chamber 311*a* in order to discharge the compressed air out of the piston chamber 311*a* into a tank 316*b*.

Figure 22:
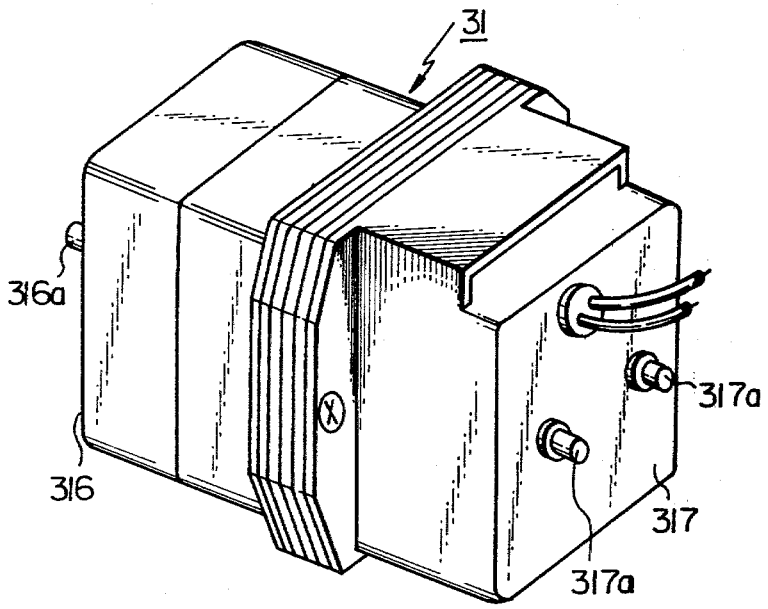
FIG. 22 is a perspective view of one embodiment of the compressor used for the stand assembly shown in FIGS. 20 and 21.

A pin 316*a* projects axially outwards from a front closure 316 of the compressor 31 and a pair of pins 317*a* project outwards from a rear closure of the compressor 31, respectively, for the later described suspensible support of the compressor 31 within the stand 32 (see FIG. 22). The pins 317*a* are used for blocking the compressor 31 against turning about its own axis.

The stand 32 is comprised of a truncated conical side wall 321 and a bottom wall 322 for defining a chamber to accommodate the compressor 31.

A pair of upright supporting legs 323 and 324 project from the top surface of the bottom wall 322 while being adequately spaced from each other. A U-shaped hollow 323*a* is formed atop the one supporting leg 323 while a pair of U-shaped hollows 324*a* are formed atop the other supporting leg 324. Resilient seats 323*b* and 324*b* are coupled in the U-shaped hollows 323*a* and 324*a*, respectively, in order to receive the pins 316*a* and 317*a* of the compressor 31.

Figure 23:
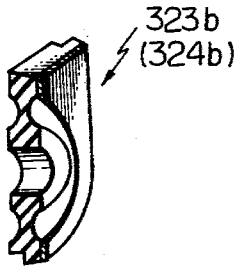
FIG. 23 is a perspective view of seats used for suspensible support of the compressor in the stand assembly shown in FIGS. 20 and 21.

The suspensible support for the compressor 31 should preferably absorb vibration of the compressor 31 during operation of the latter. For this effect, the intermediate section of the seats 323*b* (324*b*) is formed thinner than the central section and the peripheral section thereof, the central section being receptive of the pin 316*a* (317*a*) and the peripheral section being coupled to the U-shaped hollow 323*a* (324*a*) as shown in FIG. 23.

Additional pair of upright supporting legs 325 and 326 are formed on the bottom wall 322, one being on the fore side of the supporting leg 323 and the other on the rear side of the supporting leg 324. A tank cover 327 is mounted atop the supporting legs 325 and 326 via fastening screw 327*a* while spacedly covering the compressor 31. The lower edges 327*b* of the tank cover 327 are in abutment against the top surfaces of the seats 323*b* and 324*b* in order to block them against falling out of the associated U-shaped hollows 323*a* and 324*a*. The tank cover 327 internally defines a second tank 327*c*.

The second tank 327*c* and the tank 316*b* of the compressor 31 are connected to each other by means of a hose pipe 328 and a discharge pipe 329 of the second tank 327*c* is provided at the downstream terminal with a coupling half 329*a*.

When the compressor 31 is directly mounted onto the bottom wall 322 of the stand 32, vibration of the compressor 31 caused by reciprocal movement of the piston assembly 313 is directly transmitted to the side wall 321 via the bottom wall 322.

In accordance with the present invention, the compressor 31 is suspensibly supported within the stand 32 by means of resilient seats 323*b* and 324*b* on the supporting legs 323 and 324. In addition, the above-described specially designed shape of the seats 323*b* and 324*b* (see FIG. 23) enables effective adsorption of the vibration generated by the compressor 31 whose pins 316*a* and 317*a* are received by these seats 323*b* and 324*b*. Further, as diametral movement of the pins 316*a* and 317*a* is limited by the lower edges 327*b* of the second tank cover 327, turning of the compressor 31 about its own axis is effectively blocked. Therefore, the resultant simple axial vibration of the compressor 31 can well be damped by the resilient seats 323*b* and 324*b* only. Since the seats 323*b* and 324*b* are blocked against vertical movement by the lower edges 327*b* of the second tank cover 327, it is not required to fix the seats 323*b* and 324*b* within the associated U-shaped hollows 323*a* and 324*a*. That is, the above-described damping construction can be obtained by inserting the seats 323*b* and 324*b* into the associated U-shaped hollows 323*a* and 324*a* only.

Figure 24:
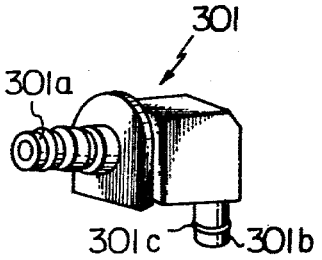
FIG. 24 is a perspective view of a coupling block used for the stand assembly shown in FIGS. 20 and 21.

In a preferred embodiment of the bubble wash unit in accordance with the present invention, the stand 32 may include a coupling block 301 shown in FIG. 24. The coupling block 301 is provided with a male coupling half 301*a* which corresponds to the coupling half 329*a*. The coupling block 301 is further provided with a male coupling half 301*b* with a seal ring 301*c* which is adapted for coupling with the downstream terminal of the discharge pipe 329 from the second tank 327*c*. The coupling block 301 is detachably mounted to the connecting ring 34 of the stand assembly.

In the case of the foregoing embodiments, the electric system of the compressor 31 is directly connected to a given electric power supply source. Although leakage of water in the wash basin 1 into the interior of the stand assembly 3 is well prevented in the bubble wash unit of the present invention, there still is a possibility that water may leak into the interior of the stand assembly 3 for any reason and wet the electric system of the compressor 31. In other words, there is a danger of electric shock on users of the bubble wash unit. With the recent trend of using electrically non-conductive building materials such as drain pipes, it is increasingly difficult to reliably ground the electric system of the compressor. In addition, when the bubble wash unit is used at home, a 100 V electric power source is in general used for driving the compressor 31. For these reasons, possible water leakage in the bubble wash unit may cause dangerous electric shock accident.

Figure 25:
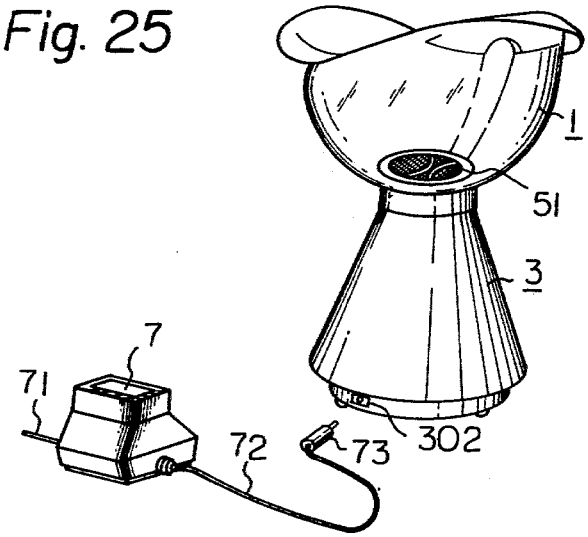
FIG. 25 is a perspective view of still further embodiment of the bubble wash unit in accordance with the present invention.

A further embodiment of the bubble wash unit of the present invention shown in FIG. 25 successfully precludes the above-described danger of electric shock to be caused by possible water leakage.

As already described, the compressor 31 is contained in the stand assembly 3 which is provided on the side wall near the bottom with an input jack 302. A transformer 7 is provided with one lead 71 to be connected to the home electric power source of 100 V and another lead 72 having an output jack 73 which is to be inserted into the input jack 302 of the bubble wash unit. The transformer 7 has a function to lower the voltage of the electric power from 100 to about 12 V which greatly enfeebles electric shock on the users.

In accordance with the outstanding embodiment of the bubble wash unit, electric shock on the users to be caused by possible water leakage can be enfeebled greatly. In addition, by using long electric lead 72, even the transformer 7 can be placed remote from the bubble wash unit so that the transformer should not be wetted by accidental splashing of water in the wash basin.

As hereinbefore described, the atmosphere is once sucked into the pneumatic system of the compressor 31 before supply to the bubbling assembly 5 and the compressor 31 includes the electric system which should be protected against wetness. Further, the water in the wash basin 1 may splash to the space and places around the bubble wash unit. When the atmosphere is taken into the compressor from the space adjacent to the bubble wash unit under such a situation, wet air may give ill influence upon the electric system within the compressor. For this reason, it is preferable to collect the atmosphere at a position remote from the bubble wash unit.

Figure 27:
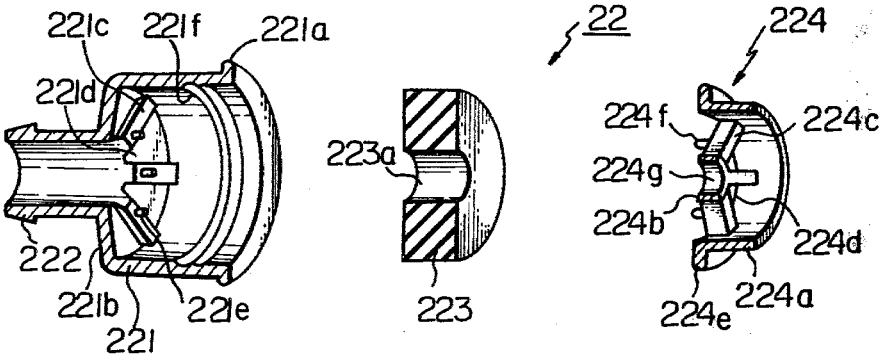
FIG. 27 is a perspective view of a collecting assembly used for the atmosphere collector shown in FIG. 26 in a disassembled state.
Figure 26:
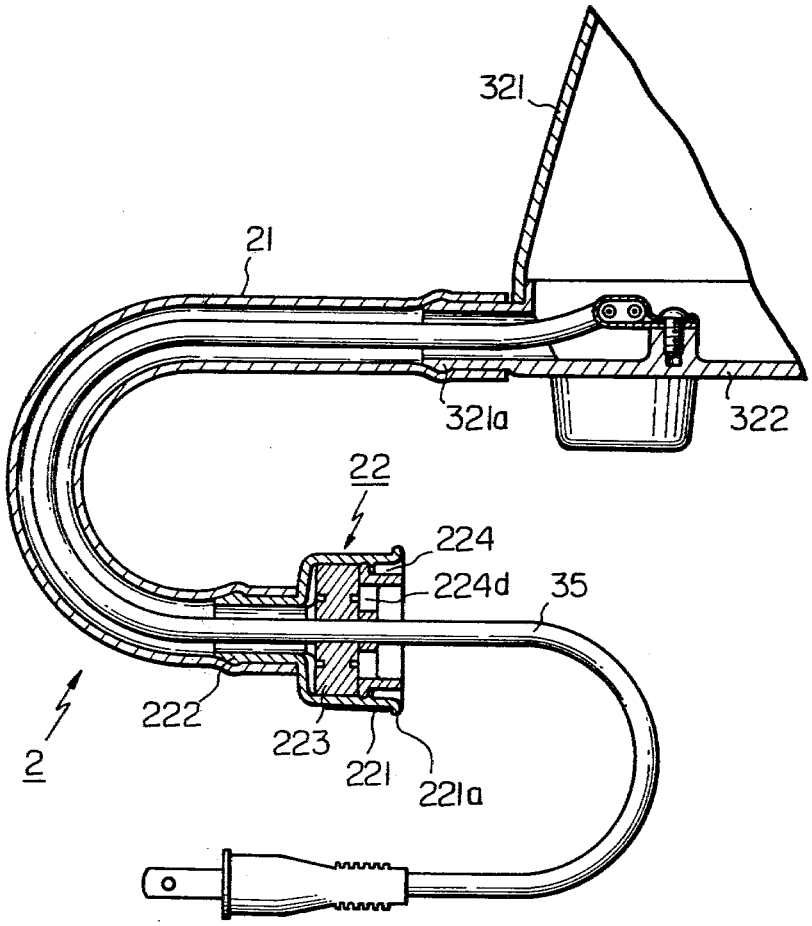
FIG. 26 is a side sectional view of one embodiment of the atmosphere collector used for the bubble wash unit in accordance with the present invention.

One embodiment of atmosphere collector 2 shown in FIGS. 26 and 27 well meets this requirement. A coupling jack 321*a* is formed on the side wall 321 of the stand 32 near the bottom wall 322. The atmosphere collector 2 comprises a hose pipe 21 coupled at one end to the above-described coupling jack 321*a* of the stand 32. The hose pipe 21 extends while spacedly covering the electric lead 35 for connecting the electric system of the compressor 31 to the given supply source of electric power. The hose pipe 21 is further provided at the other end thereof with a collecting assembly 22. The collecting assembly 22 includes a tubular main body 221 opening on both axial ends, a coupling jack 222 formed in one body with the main body 221 and adapted for coupling with the above-described the other end of the hose pipe 21, a filter 223 accommodated within the main body 221 and a pressor 224 for keeping the filter 223 in position within the main body 221.

The main body 221 is provided with an outer brim 221*a* on the collecting end. On the inner side surface of the section 221*b* connecting the coupling jack 222 to the main body 221, a plurality of radial ribs 221*c* are formed for defining air passages 221*d* between neighboring ribs 221*c*. Each rib 221*c* is provided with a projection 221*e*. The main body 221 is further provided in the inner surface with an annular groove 221*f*.

The filter 223 takes the form of a tubular body having a center hole 223*a* which admits smooth passage of the electric lead 35.

The pressor 224 includes an outer tube 224*a* and an inner tube 224*b* coaxially coupled each other by a plurality of radial ribs 224*c*. Air passages 224*d* are formed between the neighboring ribs 224*c*. The outer tube 224*a* is provided with a brim 224*e* on the end opposite to the collecting end of the collector 2. Each rib 224*c* is provided with a projection 224*f*. The center hole 224*g* of the inner tube 224*b* admits smooth passage of the electric lead 35.

In the assembled state of the collecting assembly 22, the pressor 224 is firmly coupled to the main body 221 by snap coupling of its brim 224*e* with the annular groove 221*f* of the main body 221 and the filter 223 is firmly clamped between the projections 221*e* of the main body 221 and the projections 224*f* of the pressor 224.

In accordance with this embodiment of the atmosphere collector, the portion of the electric lead close to the bubble wash unit is covered by the hose pipe and the collecting assembly is located remote from the bubble wash unit. Thus, suction of wet air can be avoided, thereby mitigating wet damage on the electric system of the compressor. Even when the collecting assembly is placed directly on the wet floor of a bath room, the presense of the outer brim 221*a* of the main body 221 and the outer tube 224*a* of the pressor 224 prevents traveling of water to the filter 223. To presence of a number of air passages 221*d* and 224*d* assures collection of a sufficient amount of air. In order to keep the electric lead 35 from contact with water, it is advantageous to design the hose pipe long enough to locate the collecting assembly adjacent to the electric jack of the lead 35.

In accordance with the present invention, the wash basin 1 and the stand assembly 3 are assembled to each other via the so-called bayonet coupling. Therefore, the two elements 1 and 3 are disassembled from each other when the one is turned about the other. The bubble 51 (54) disc within the wash basin 1 is connected to the compressor 31 within the stand assembly 3 by means of the bubbling assembly 5 which sits astride the upper edge of the water basin 1. Thus, if the user tries to disassemble the wash basin 1 from the stand assembly 3 without removing the bubbling assembly 5 in advance, the bubbling assembly 5 is pulled by the wash basin 1 just leaving the stand assembly 3, thereby causing undesirable overturning of the stand assembly 1, which often leads to malfunction of the compressor 31 contained within the stand assembly 1.

Figure 30:
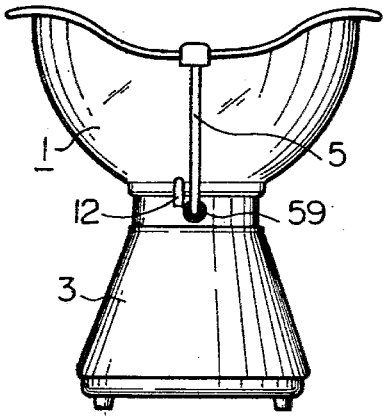
FIG. 30 is a back view of the bubble wash unit using the wash basin shown in FIG. 28.
Figure 28:
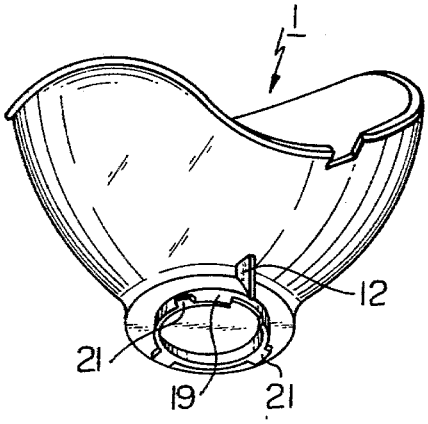
FIG. 28 is a bottom perspective view of a still further embodiment of the wash basin used for the bubble wash unit in accordance with the present invention.
Figure 29:
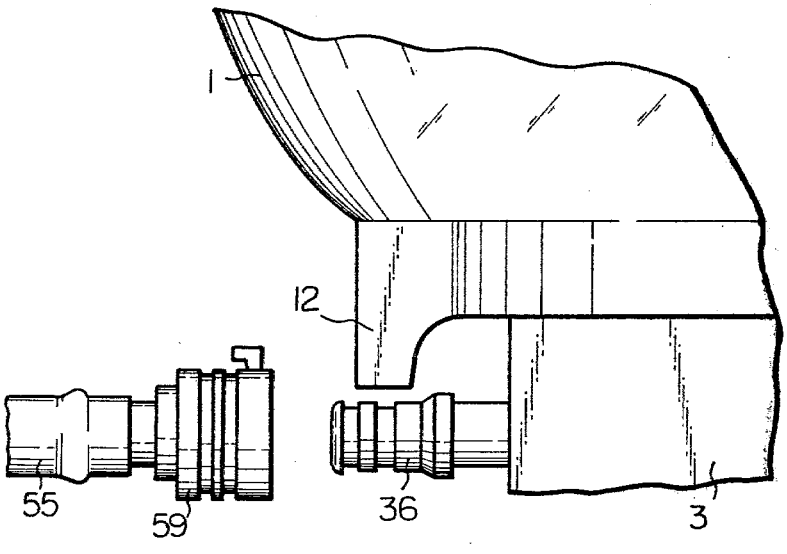
FIG. 29 is an enlarged fragmentary view of the bubble wash unit using the wash basin shown in FIG. 28.

A still further embodiment of the bubble wash unit shown in FIGS. 28, 29 and 30 effectively avoids the above-described overturning trouble. The wash basin 1 of this embodiment is provided, at a position near the bottom connecting ring 19, with a stopper 12 projecting radially outwards.

In the assembled state of the two elements 1 and 3 shown in FIG. 29, the wash basin 1 is freely turnable about the stand assembly 3 since the lower edge of the stopper 12 is located slightly above the highermost edge of the male half 36 of the pipe coupling. When the female half 59 of the air hose pipe 55 is coupled to the male half 36 of the stand assembly 3, however, turning of the wash basin 1 is limited due to abutment of the stopper 12 against the female half 59 which is larger in diameter than the male half 36, thereby disabling separation of the elements 1 and 3 (see FIG. 30). In other words, the wash basin 1 cannot be separated from the stand assembly 3 so long as the bubbling assembly 5 is coupled to the stand assembly 3. Thus, unexpected overturning of the stand assembly 3 can be well obviated even when the user carelessly tries to separate the wash basin 1 without disconnecting the bubble assembly 5 from the stand assembly, thereby greatly minimizing accident of the compressor 31.

We claim:

1. An improved bubble wash unit comprising a wash basin in the form of a bowl, said wash basin having an inner side and an outer side meeting at an upper edge of said wash basin.

a stand assembly detachably coupled to the bottom of said wash basin and internally accommodating a compressor, and a bubbling assembly which includes a bubble disc placed on the inside bottom of said wash basin and means for connecting said bubble disc pneumatically to said compressor, said connecting means extending from said bubble disc, over said inner side and then over said upper edge and over said outer side of said wash basin so that said connecting means sits astride said upper edge of said wash basin.

2. An improved bubble wash unit as claimed in claim 1 in which said upper edge of said wash basin is comprised of a pair of facing upwardly convex sections alternately arranged with a pair of facing upwardly concave sections.

3. An improved bubble wash unit as claimed in claim 2 in which said upper edge of said wash basin is provided with an outwardly projecting brim, and the extent of projection of said brim is larger in said upwardly convex section than in said upwardly concave sections.

4. An improved bubble wash unit as claimed in claim 2 in which a cut out is formed in one of said upwardly concave sections of said wash basin.

5. An improved bubble wash unit as claimed in claim 1 in which said connecting means include an air conduit member detachably coupled at the downstream end thereof to said bubble disc and taking the form of a flat cavitious band, an air hose pipe detachably coupled at the upstream end thereof to said compressor, and a connecting block detachably interposed between said air conduit member and said air hose pipe and detachably coupled to said upper edge of said wash basin.

6. An improved bubble wash unit as claimed in claim 5 in which said air conduit member is made of a resilient material.

7. An improved bubble wash unit as claimed in claim 5 in which said connecting block includes a first block half provided with a first coupling section for said air conduit member and internally defining a first chamber in communication with said first coupling section, a second block half provided with a second coupling half for said air hose pipe and internally defining a chamber in communication with said second coupling section, a check valve placed within said first chamber, and means for resiliently urging said check valve to block flow of water from said first to second chamber while allowing flow of air from said second to first chamber.

8. An improved bubble wash unit as claimed in claim 7 in which said connecting block is provided with a transverse groove suited for meshing engagement with said upper edge of said wash basin.

9. An improved bubble wash unit as claimed in claim 1 in which said bubble disc comprises a top cover including an annular section having a sharp annular projection formed in the rear side surface thereof, a central section and a plurality of ribs connecting said two sections while defining open windows between them, a bubble former including a mesh layer having numerous fine meshes, and a holder ring disposed to the periphery of said mesh layer and having an annular resilient valve formed on the rear side surface thereof, a bottom closure having an annular groove in the fore side surface thereof whose outer side peripheral wall is in neat contact with the outer surface of said valve, and means for fastening said top cover, bubble former and bottom closure together in such an arrangement that said holder ring of said bubble former is in pressure contact with the rear side surface of said annular section of said top cover and the outer periphery of said bottom closure is in neat contact with the inner periphery of said annular section of said top cover.

10. An improved bubble wash unit as claimed in claim 9 in which said bottom closure is provided with an annular groove formed in the periphery thereof and receptive of a seal ring.

11. An improved bubble wash unit as claimed in claim 9 in which said bubble disc further includes an intermediate plate interposed between said bubble former and said bottom closure.

12. An improved bubble wash unit as claimed in claim 9 in which said mesh layer is made of woven fabric.

13. An improved bubble wash unit as claimed in claim 9 in which said mesh layer is made of non-woven fabric.

14. An improved bubble wash unit as claimed in claim 9 in which said mesh layer is made of a thin perforated stainless steel disc formed by chemical etching.

15. An improved bubble wash unit as claimed in claim 14 in which the thickness of said stainless steel disc is in the order of 0.1 mm.

16. An improved bubble wash unit as claimed in claim 14 in which the diameter of perforations is in the order of 0.2 mm.

17. An improved bubble wash unit as claimed in claim 14 in which the distance between neighboring perforation is in the order of 2 mm.

18. An improved bubble wash unit as claimed in claim 14 in which said holder ring is made of a synthetic resin, and said stainless steel disc is formed in one body with said holder ring at molding of the latter.

19. An improved bubble wash unit as claimed in claim 1 in which said bubble disc includes an annular holder, a mesh layer having numerous fine meshes, a bottom closure having a supporting section, a leg section formed on the rear side of said supporting section, and a bottom section formed on the inner side of said supporting section and provided with an air conduit opening in the fore side surface thereof, and means for establishing a bayonet coupling between said holder and said bottom closure in such an arrangement that said mesh layer is firmly clamped between them.

20. An improved bubble wash unit as claimed in claim 19 in which said mesh layer is made of woven fabric.

21. An improved bubble wash unit as claimed in claim 19 in which said mesh layer is made of non-woven fabric.

22. An improved bubble wash unit as claimed in claim 19 in which said mesh layer is made of a thin perforated stainless disc formed by chemical etching.

23. An improved bubble wash unit as claimed in claim 22 in which the thickness of said stainless steel disc is in the order of 0.1 mm.

24. An improved bubble wash unit as claimed in claim 22 in which the diameter of perforations is in the order of 0.2 mm.

25. An improved bubble wash unit as claimed in claim 22 in which the distance between neighboring perforations is in the order of 2 mm.

26. An improved bubble wash unit as claimed in claim 19 in which said bottom closure is provided in the fore side surface thereof with an annular groove, and a seal ring is received within said annular groove.

27. An improved bubble wash unit as claimed in claim 19 in which said bayonet coupling establishing means include a plurality of resilient locking projections formed on the outer periphery of said holder, and the same number as said plurality of resilient locking pieces formed on the inner periphery of said supporting section of said bottom closure and adapted for said bayonet coupling with said locking projections of said holder.

28. An improved bubble wash unit as claimed in claim 1 in which said bubble disc includes an annular top cover made of synthetic resin, a thin perforated stainless steel disc which is made by chemical etching and formed in one body with said top cover at molding of the latter, and a bottom closure which is coupled in one body with said top cover and provided with an air conduit opening in the fore side surface thereof.

29. An improved bubble wash unit as claimed in claim 1 in which said bubble disc includes an annular top cover made of synthetic resin, a bottom closure which is coupled in one body with said top cover, and provided with an annular projection formed on the fore side surface thereof and an air conduit opening in said surface, a thin perforated stainless steel disc made by chemical etching, and a resilient protector ring disposed to the periphery of said stainless steel disc and snugly received within a space defined by said bottom closure.

30. An improved bubble wash unit as claimed in claim 28 or 29 in which the thickness of said stainless disc is in the order of 0.1 mm.

31. An improved bubble wash unit as claimed in claim 28 or 29 in which the diameter of perforations is in the order of 0.2 mm.

32. An improved bubble wash unit as claimed in claim 28 or 29 in which the distance between neighboring perforations is in the order of 2 mm.

33. An improved bubble wash unit as claimed in claim 1 in which said stand assembly includes a hollow stand, and means for suspensibly holding said compressor within said stand.

34. An improved bubble wash unit as claimed in claim 33 in which said suspensibly holding means includes at least a first pin projecting from one axial end of said compressor, at least two second pins projecting from the other axial end of said compressor, a pair of supporting legs projecting upwards from the bottom wall of said stand and provided with hollows at the tops thereof, one hollow being for said first pin and the other being for said second pins, and resilient pin seats disposed within said hollows.

35. An improved bubble wash unit as claimed in claim 34 in which said suspensibly holding means further includes a pair of additional supporting legs arranged near said supporting legs, a tank cover internally defining an air tank, mounted atop said additional supporting legs, and having a lower edge in pressure contact with said pin seats.

36. An improved bubble wash unit as claimed in claim 35 further comprising a coupling block detachably disposed to the side wall of said stand and provided with two terminals, one being pneumatically coupled to said bubbling assembly and the other being pneumatically connected to said tank.

37. An improved bubble wash unit as claimed in claim 1 in which said stand assembly includes a resilient hose pipe spacedly covering the starting sections of an electric lead from said compressor, and a collecting assembly coupled to the upstream end of said hose pipe and internally provided with a filter snugly inserted over said electric lead.

38. An improved bubble wash unit as claimed in claim 37 in which said collecting assembly further including means for detachably retaining said filter within said collecting assembly via snap coupling.

39. An improved bubble wash unit as claimed in claim 1 further comprising an input terminal for said compressor formed on said stand assembly, and a transformer interposed between a given electric power source and said input jack in order to lower the voltage of electric power supplied to said compressor.

40. An improved bubble wash unit as claimed in clain 39 in which said voltage is lowered to the level of 12 V by said transformer.

41. An improved bubble wash unit as claimed in claim 1 further comprising means for detachably coupling said wash basin to said stand assembly via bayonet coupling.

42. An improved bubble wash unit as claimed in claim 41 in which said coupling means include a first connecting ring formed at the bottom of said wash basin and provided with a plurality of locking projections formed on the outer periphery thereof, and a second connecting ring formed atop said stand assembly and provided with a circular hollow and a plurality of locking cutouts engageable with said locking projections when said wash basin is axially turned about said stand assembly.

43. An improved bubble wash unit as claimed in claim 41 further comprising means for barring turning of said wash basin about said stand assembly when said pneumatic connecting means of said bubbling assembly is in communication with said compressor.

44. An improved bubble wash unit as claimed in claim 43 in which said barring means include a projection formed near the bottom of said wash basin.

45. An improved bubble wash unit comprising a wash basin in the form of a bowl, said wash basin having an inner side and an outer side meeting at an upper edge of said wash basin, a stand assembly detachably coupled to the bottom of said wash basin and internally accommodating a compressor, and a bubbling assembly which includes a bubble disc placed on the inside bottom of said wash basin and means for connecting said bubble disc pneumatically to said compressor, said connecting means extending from said bubble disc, at said bottom of said basin, upwardly over said inner side of said basin off said inside bottom of said basin, then, generally at said upper edge passing from being over said inner side to being over said outer side of said basin, and said connecting means thereby not passing through said wash basin bowl at a location where liquid in said wash basin might leak through said wash basin bowl at the point of said passing through of said connecting means.

* * * * *